United States Patent [19]

Debaigt

[11] 4,174,878

[45] Nov. 20, 1979

[54] SECURITY STRUCTURE FOR POSITIONING A CLIP ON A CONNECTOR TAB

[75] Inventor: Jean Debaigt, Maisons Laffitte, France

[73] Assignee: CGEE Alsthom, Levallois Perret, France

[21] Appl. No.: 944,661

[22] Filed: Sep. 21, 1978

[30] Foreign Application Priority Data

Oct. 7, 1977 [FR] France ..... 77 30276

[51] Int. Cl.[2] ..... H01R 9/18

[52] U.S. Cl. ..... 339/198 R; 339/256 SP

[58] Field of Search ..... 339/198 R, 198 GA, 198 H, 339/198 P, 198 G, 198 S, 206 R, 206 P, 208, 210, 258 S, 256 SP

[56] References Cited

U.S. PATENT DOCUMENTS

| | | | |
|---|---|---|---|
| 2,805,405 | 9/1957 | Batcheller | 339/198 S X |
| 3,373,398 | 3/1968 | Volinskie | 339/210 R X |
| 3,601,780 | 8/1971 | De Lyon | 339/198 R X |
| 3,774,145 | 11/1973 | Vlahos | 339/210 R X |
| 4,037,912 | 7/1977 | Besser | 339/198 R |

*Primary Examiner*—Joseph H. McGlynn
*Assistant Examiner*—John S. Brown
*Attorney, Agent, or Firm*—Sughrue, Rothwell, Mion, Zinn and Macpeak

[57] ABSTRACT

The invention relates to a structure for positioning a clip on a generally flat tab disposed tonguewise in a cavity formed in the insulating casing of a connector. The structure relies on a rib extending from one wall one of the cavity and touching a large surface of the tab, said rib having, at its clip insertion orifice end, a spur which covers the end of the tab up to a level flush with the other large surface of the tab, the residual clearance between said other large surface and the facing wall of the cavity being less than the total thickness of the clip. The invention applies to clip-connected connectors.

2 Claims, 4 Drawing Figures

SECURITY STRUCTURE FOR POSITIONING A CLIP ON A CONNECTOR TAB

FIELD OF THE INVENTION

The invention relates to a security arrangement for positioning a clip on a generally flat connector tab, e.g. a spade terminal.

BACKGROUND OF THE INVENTION

Such a clip is normally fixed on a tab disposed in the longitudinal axis of a cavity formed in an insulating housing of a connector, the clips and the tabs usually being of a standard type. Clips which are fixed on tabs are made of cut-out and bent sheet metal.

Due to inevitable dimensional variations in production, circumstances require play compatible with given tolerances to be provided in the cavities in which the clips are to be inserted.

Further, it is not always certain that a clip will be properly clipped exactly perpendicularly on the tab. Indeed, the clip may happen to be inserted in between one side of the tab and the wall of the cavity facing that side, this causing faulty contact between the clip and the tab and, independently, precarious positioning of the clip in the cavity.

Preferred embodiments of the present invention provide a security arrangement which ensures that if a clip appears to be fixed on a tab in a cavity, then the clip is properly positioned both electrically and mechanically.

SUMMARY OF THE INVENTION

The invention provides a security structure for positioning a clip on a generally flat tab disposed in a cavity formed in the insulating housing of a connector, wherein the wall of the cavity has a rib which extends against one of the large surfaces of the tab, said rib having, at its clip insertion orifice end, a spur which covers the end of the tab up to a level flush with the other large surface of the tab, the clearance between the said other large surface and the facing wall of the cavity being less than the total thickness of the clip.

Preferably the end of the spur which faces the clip insertion orifice has a ramp inclined towards the inside of the cavity.

An embodiment of the invention is described hereinbelow by way of example with reference to the accompanying drawings.

DESCRIPTION OF THE PREFERRED EMBODIMENT

Figure 1:
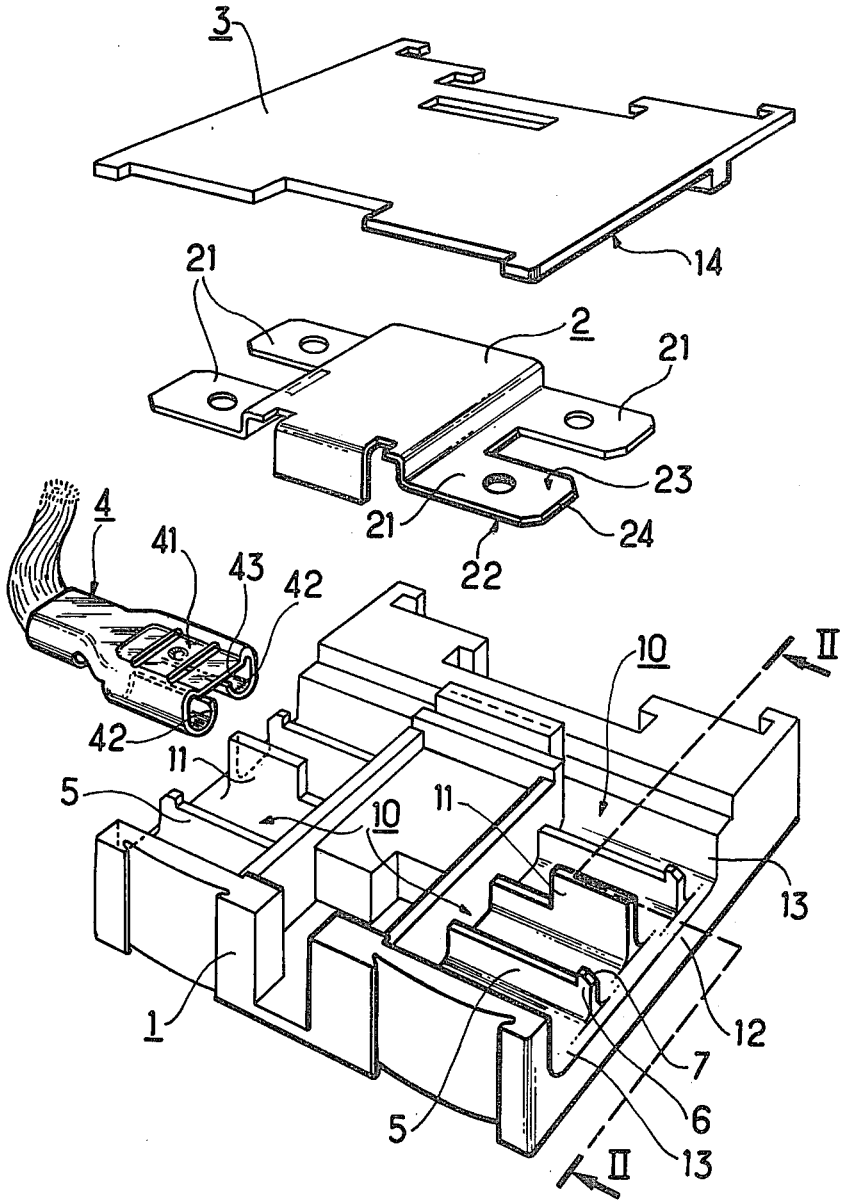
FIG. 1 is an exploded perspective view of a connector which includes a security structure in accordance with the invention.
Figure 2:
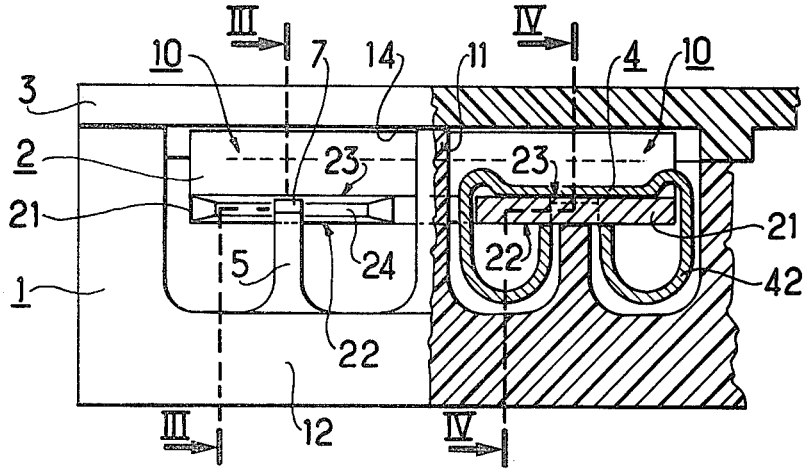
FIG. 2 is a partial cross-section front view along line II—II of the connector of FIG. 1, with the right-hand cavity being provided with a clip.
Figure 3:
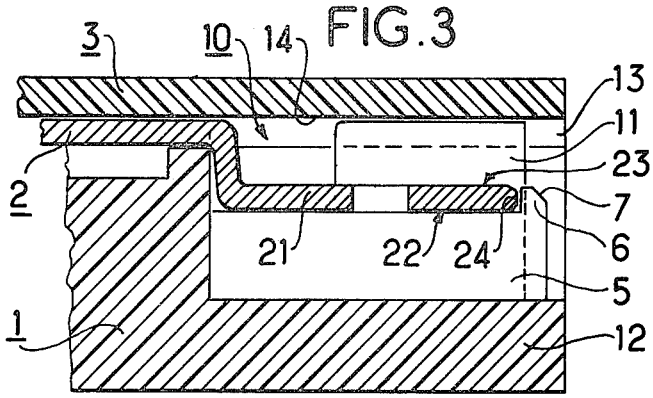
FIG. 3 is a cross-sectional view along line III—III of the connector of FIG. 2.
Figure 4:
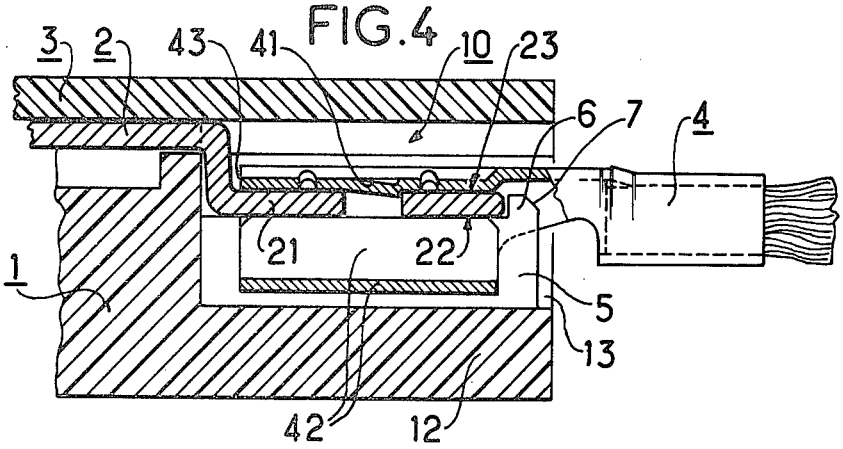
FIG. 4 is a cross-sectional view along IV—IV of the connector of FIG. 2.

In the figures, the insulating housing 1 of a connector which has a set of recesses intended to accommodate a connection plate 2 and which is closed by a detachable insulating partition 3.

The insulating housing therefore has, in particular, on each of its opposite surfaces, two cavities 10 with an approximately rectangular cross-section each intended to accommodate a corresponding tab 21. The tabs 21 project in pairs from the opposite sides of the plate 2.

The tabs 21 are flat, forming opposed large surfaces 22 and 23, and are intended, when inside the cavities 10, to be plugged into clips 4 each of which is constituted by a central plate 41 with two curved fixing rims on either side which constitute lateral grips 42. Each tab 21 which is disposed in the central portion of a cavity 10 has one of its large surfaces 22 applied against a longitudinal rib 5 occupying the middle portion of one of the large walls 12 of the cavity. At the orifice 13 through which the clip is inserted, the rib 5 has a spur 6 which covers the end 24 of the tab up to a level flush with its other large surface 23. The sizes of the cavity 10 and of the rib 5 are such that the clearance remaining between the said other large surface 23 of the tab and the facing wall 14 of the cavity 10 is less than the total thickness of the clip 4.

Further, on its end facing the clip insertion orifice 13, the spur 6 has a ramp 7 which is inclined towards the inside of the recess 10.

The structure operates as follows.

With the plate 2 fixed in the housing, and while a clip 4 is being fixed onto the tab 21 in one of the cavities 10, the end 43 of the clip 4 is guided by the ramp 7 towards the clearance in the cavity lying between the surface 23 of the tab and the wall 14 of the cavity. If the lateral grips 42 of the clip 4 are turned towards the rib 5, the clip 4 engages the tab normally and the clip can only occupy a correct position. If the grips are turned away from the rib 5, it is impossible to fix the clip on the tab in the cavity.

In these conditions, the security provided by the structure appears to be satisfactory.

I claim:

1. In a security structure for positioning a clip on a generally flat tab disposed in a cavity formed in the insulating housing of a connector and defined by opposed, spaced walls, wherein one of said walls of the cavity has a rib which extends against one of the large surfaces of the tab, said rib having, at its clip insertion orifice end, a spur which covers the end of the tab up to a level flush with its other large surface of the tab, the clearance between said other large surface and the other facing wall of the cavity being less than the total thickness of the clip.

2. A structure according to claim 1, wherein the end of the spur which faces the clip insertion orifice has a ramp inclined towards the inside of the cavity.

* * * * *